US005269286A

United States Patent [19]

Cowan

[11] Patent Number: 5,269,286

[45] Date of Patent: Dec. 14, 1993

[54] COMBUSTION CHAMBER APPARATUS

[76] Inventor: Bryan M. Cowan, Claremont, Western Australia, Australia, 6010

[21] Appl. No.: 941,185

[22] Filed: Sep. 3, 1992

[30] Foreign Application Priority Data

Sep. 6, 1991 [AU] Australia ..... PK8236

[51] Int. Cl.[5] ..... F24B 3/00

[52] U.S. Cl. ..... 126/25 B; 126/25 R; 126/9 B

[58] Field of Search ..... 126/25 B, 25 R, 29, 126/9 A, 9 B, 152 R, 152 B

[56] References Cited

U.S. PATENT DOCUMENTS 1,448,148 3/1923 O'Kane ..... 126/29
2,488,014 11/1949 Higman ..... 126/25 R X
2,746,378 5/1956 Lang ..... 126/275 R
3,028,228 4/1962 Chaplin ..... 126/25 B
3,841,299 10/1974 Tomita .
3,848,577 11/1974 Storandt .
3,915,145 10/1975 Tomita .
4,026,265 5/1977 Spadaro .
4,331,125 5/1982 Storandt ..... 126/29 X
4,603,679 8/1986 Ogden ..... 126/25 B
4,896,650 1/1990 Hait ..... 126/152 B X

FOREIGN PATENT DOCUMENTS 2587788 3/1987 France .

*Primary Examiner*—Carl D. Price
*Attorney, Agent, or Firm*—Bachman & LaPointe

[57] ABSTRACT

The present invention relates to a combustion chamber apparatus, particularly for use with covered kettle cookers. The chamber apparatus comprises a hollow open ended chamber arranged to receive a firelighting cake therein, an apertured grill located above the chamber and spaced apart therefrom, an apertured plate mounted on an upper surface of the chamber, the plate and the grill serving to define an upper space in fluid communication with the interior of the chamber.

6 Claims, 4 Drawing Sheets

COMBUSTION CHAMBER APPARATUS

BACKGROUND OF THE INVENTION

The present invention relates to a combustion chamber apparatus.

The combustion chamber apparatus of the present invention may be used for the ignition of solid fuels in covered kettle cookers and other barbeque apparatus. Covered kettle cookers and barbeques use solid fuels in the form of charcoal and/or fuel briquettes formed of compressed char or charcoal. To ignite the solid fuels it is common practice to place one or more lighted firelighting cakes in the base of the cooking apparatus and place solid fuel on top. Heat and flame from the firelighters eventually causes the solid fuel to ignite. Cooking commences when the solid fuel reaches the desired temperature and will maintain a sustainable fire. It is not uncommon for the process of igniting the barbecue fuel and attaining the desired temperature to take up to 45 minutes or longer.

Moreover, the firelighters used to promote the ignition of the beads are traditionally based on solid hydrocarbons. The covering of the firelighter with solid fuel often leads to there being insufficient air space available for complete combustion of the firelighter leading to the production of quantities of smoke composed of unburnt fuel air mixture, and unreliable ignition as the flames from the firelighter are often extinguished. Thus, further time may pass before cooking may commence.

A number of earlier devices have been proposed to enable charcoal and other fuels to be heated and fires to be started in outdoor cooking equipment. Such devices are exemplified in U.S. Pat. Nos. 3,841,299 (Tomita), U.S. No. 3,915,145 (Tomita), U.S. No. 4,026,265 (Spadaro) and U.S. No. 3,848,577 (Storanolt). A further example may be formed in FR 2587788 (Michel). Each of these documents discloses a generally cylindrical chamber with a combustion chamber in the lower part of the cylinder and an upper charcoal chamber. A flat grate separates each of the chambers and charcoal rests on the grate.

The devices disclosed in each of the above suffer from a number of defects which adversely affects their utility and has prevented their adoption by the general public. In general, the prior art devices mentioned do not operate efficiently and substantial quantities of firelighting material or firelighting cakes are generally required to encourage the charcoal or fuel to burn. This may result in tainting of the food and increases the cost of operating the apparatus.

The inefficiency of the prior art devices may generally be attributed to the poor transfer of heat from the firelighting material to the charcoal or other fuel which occurs. The burning firelighting material may be considerably distanced from the charcoal giving rise to difficulties with producing a high enough temperature to instigate burning in the charcoal.

The devices described in the prior art have been arranged this way to ensure that air is able to circulate freely around the firelighting cakes. The designs are thus a compromise between providing sufficient air to burn a firelighting cake without danger of extinction by smothering the fire, whilst at the same time having the charcoal or other fuel in a suitable position to be ignited.

The prior art devices also have a number of drawbacks in the safety of their operation. Namely, that when in use, the devices described contain the hot charcoal or fuel beads which may have to be transferred manually to a separate cooker. This generally occurs by lifting the container together with the coals and inverting into the cooker. This operation is potentially hazardous and accidental spillage of hot fuel could result in serious injury to those in the immediate area.

A further problem arises when the prior art devices are operated in windy conditions or where the fuel used is very dusty. The prior art devices are commonly arranged such that it is relatively easy for dust from the charcoal or fuel beads to be transferred through a grate onto a firelighting cake. This can impede the burning of the cake or further hamper the cake of the device as a whole.

SUMMARY OF THE INVENTION

The present invention seeks to improve on the earlier devices by providing a combustion chamber apparatus which allows the firelighter cake to be positioned close to the charcoal without preventing access of air to the firelighting cake, thus providing improved transfer of heat from the burning firelighter cake to the charcoal. Moreover, the present invention also provides an apparatus which provides for the safe transfer of hot charcoal to the cooking position with only a minimum of effort being required.

According to the present invention there is provided a combustion chamber apparatus comprising a hollow open ended chamber arranged to receive a firelighting cake therein, an apertured grill located above the chamber and spaced apart therefrom, an apertured plate mounted on an upper surface of the chamber, the plate and the grill serving to define an upper space in fluid communication with the interior of the chamber.

BRIEF DESCRIPTION OF THE DRAWINGS

The present invention will now be described, by way of example, with reference to the accompanying drawings, in which.

DETAILED DESCRIPTION

Figure 1:
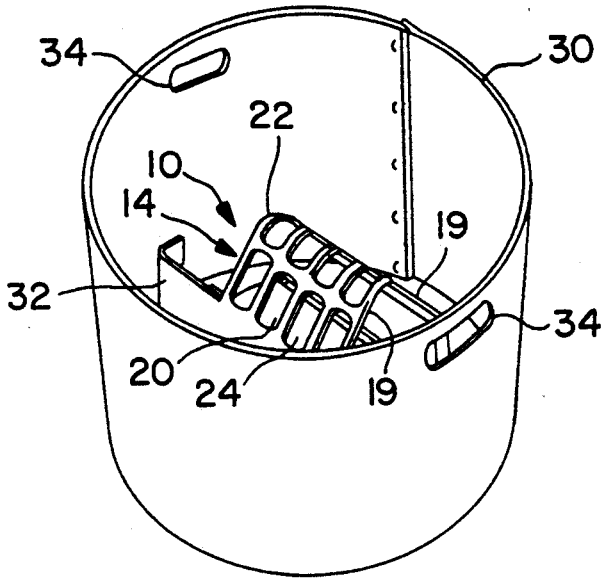
FIG. 1 is a perspective view of a combustion chamber apparatus in accordance with a first aspect of the present invention.
Figure 2:
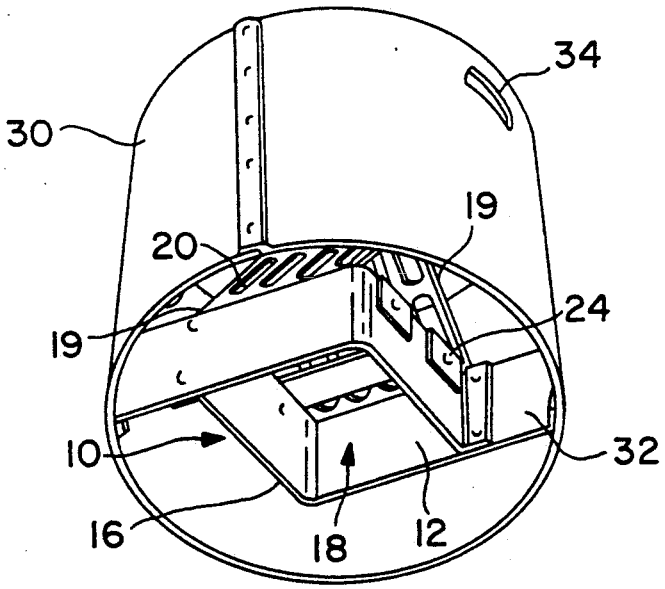
FIG. 2 is a lower perspective view of the apparatus of FIG. 1.
Figure 3:
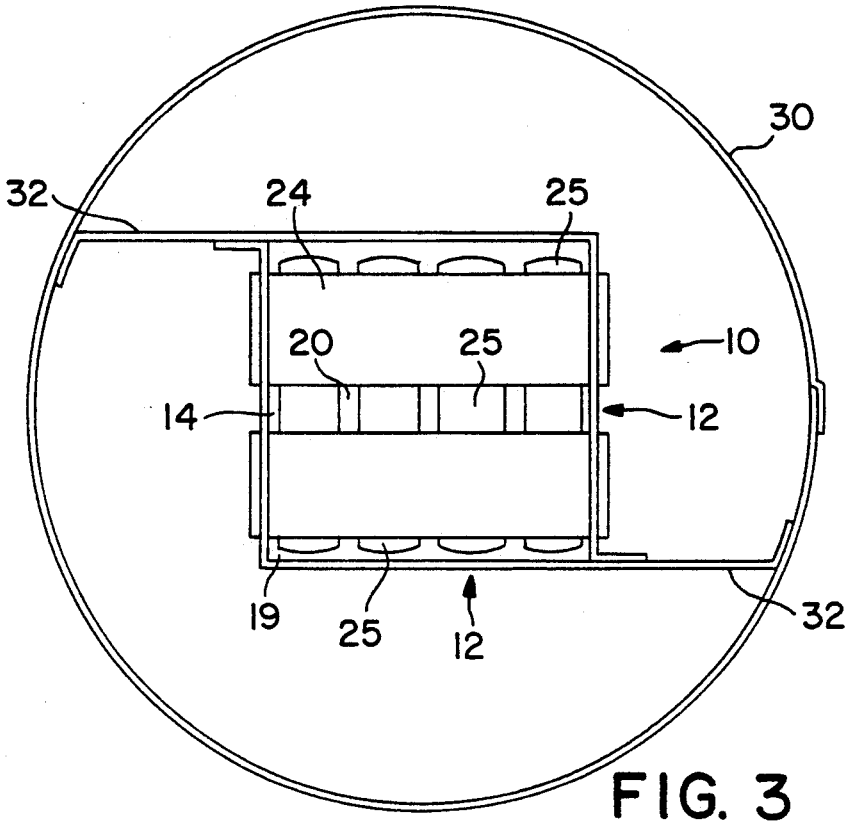
FIG. 3 is a lower plan view of the apparatus of FIG. 1.
Figure 4:
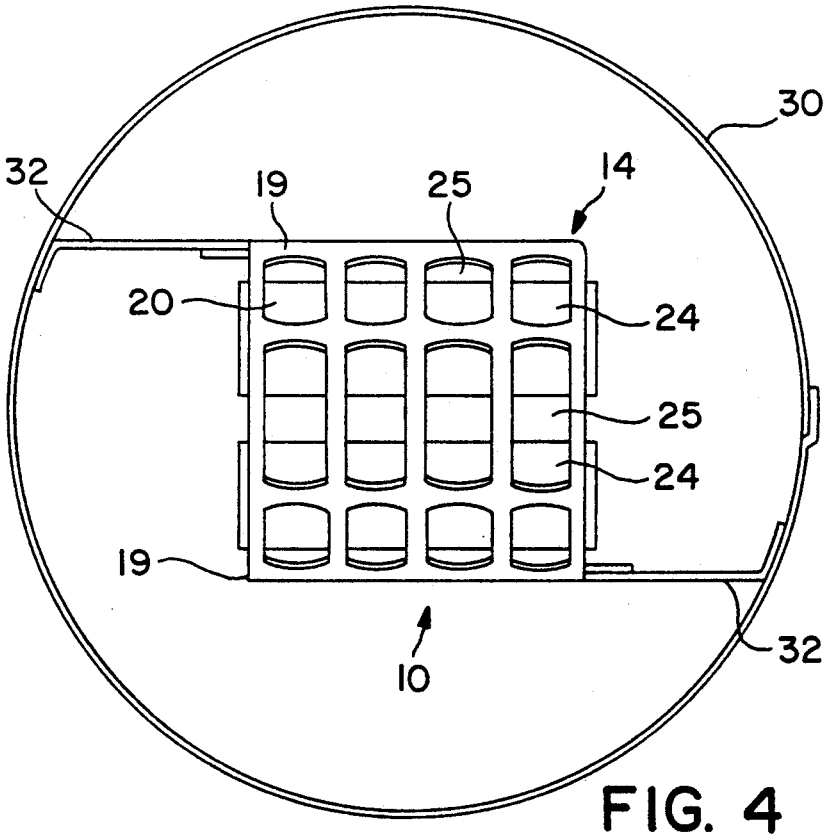
FIG. 4 is an upper plan view of the apparatus of FIG. 1.
Figure 5:
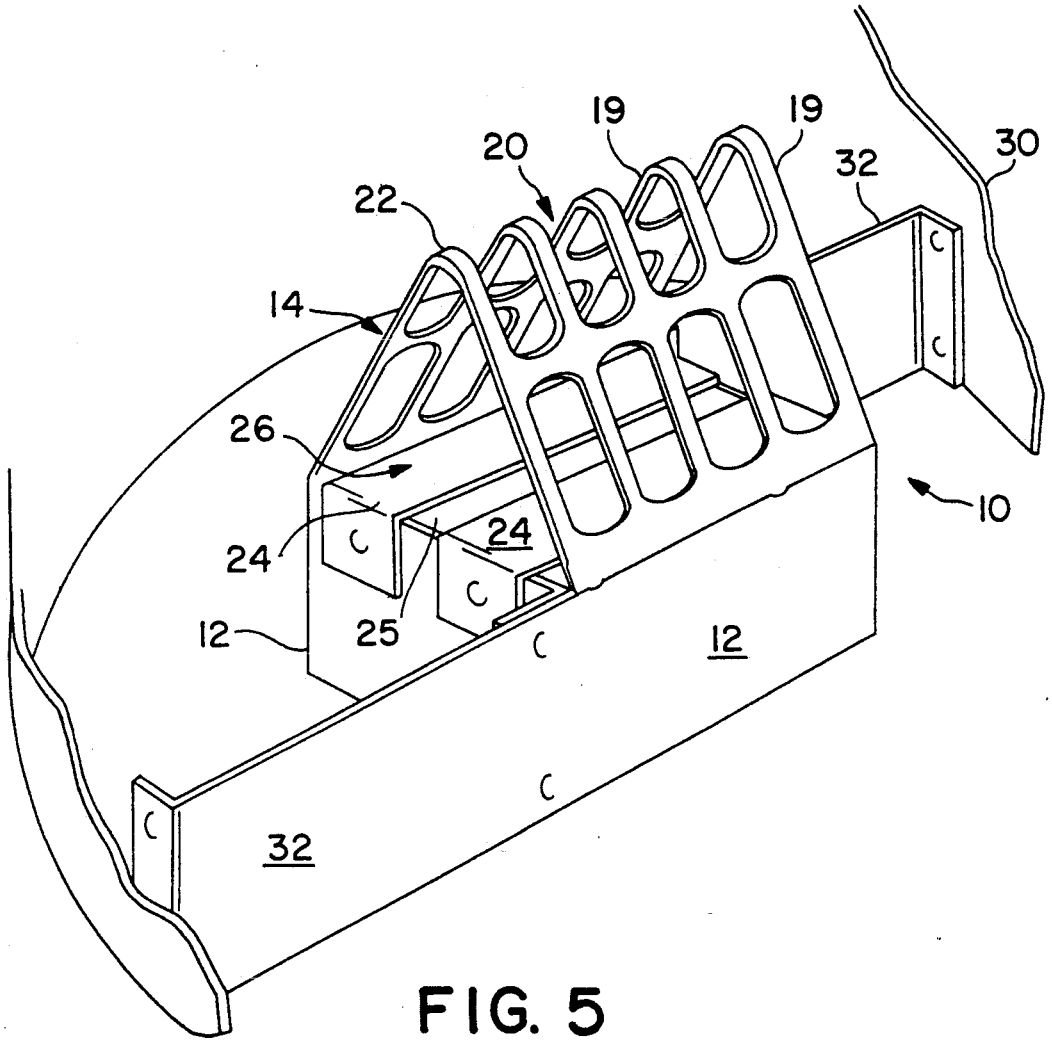
FIG. 5 is a partial view of the apparatus of FIG. 1 showing details of the chamber and FIG. 6 is a perspective view of a combustion chamber apparatus in accordance with a second aspect of the present invention.

Illustrated in FIGS. 2-5 is a hollow combustion chamber apparatus 10 comprising walls 12 and a grill 14 located above the walls 12 at an upper end thereof. The walls 12 are arranged to form a lower chamber 16 which defines an interior 18. Upper and lower ends of the chamber 16 are open.

The grill 14 comprises a pair of upwardly converging walls 19 with apertures 20. The grill 14 is attached to opposing walls 12 of the chamber 10. The walls 19 are angled upwardly so as to converge and come together in a ridge 22 above the lower chamber 16. Typically, the grill 14 has an open area of 60%.

The walls 12 of the lower chamber 16 are dimensioned so as to allow a conventional firelighting cake to be fitted into the interior space 18.

A horizontal plate 24 is located intermediate the walls 12 and the grill 14 immediately above the chamber 16. The plate 24 has slots 25 therein which extend longitudinally above the chamber 16. The plate 24 encloses the chamber 16 except for the slots 25. A central slot 25 is typically between 2.8 and 3.2 m across and the distance between each slot 20 mm. By having the upper surface of chamber 16 almost fully enclosed, the firelighter cake is protected from adverse effects of wind and dust. The plate 24 and the grill 14 define an upper space 26 which is in fluid communication with the interior 18 of the chamber 16. Thus, the interior 18 of the chamber 16 is in fluid communication with the upper space 26 through the slots 25. The combustion apparatus 10 additionally comprises a shroud 30 surrounding the chamber 10. The chamber 10 is located centrally within the shroud 30 towards a lower end thereof. The shroud 30 is an open ended hollow cylinder. Respective plates 32 are secured to two opposing walls 12 of the lower chamber 16. The plates 32 extend beyond the chamber 16 and are secured to an inner surface of the shroud 30, towards a lower edge of the shroud 30. The plates 32 and walls 12 may be integrally formed. The shroud 30 extends vertically beyond the grill 14. The interior of the shroud 30 is in fluid communication with the upper space 26 and the interior 18 of the chamber 16. A pair of horizontally extending diametrically opposed apertures 34 are located adjacent an upper edge of the shroud 30. The apertures 34 can be seen in FIGS. 1 and 2.

Figure 6:
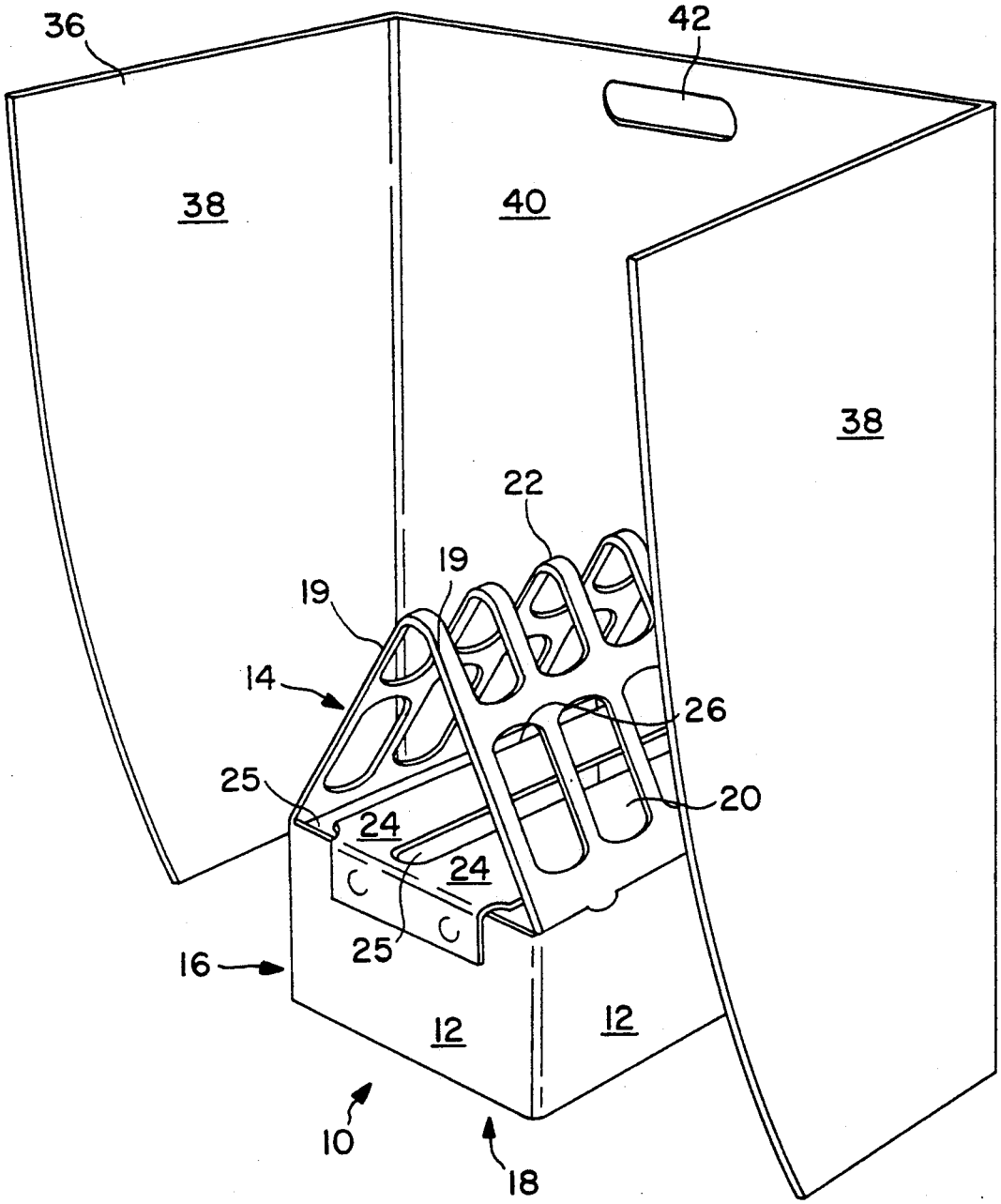

FIG. 6 depicts a third embodiment of the present invention. The combustion chamber apparatus 10 of FIG. 1 is located within an open ended three sided generally vertical channel 36. The channel 36 has sides 38 and a front face 40. The sides 38 taper inwardly towards the front face 40 at lower ends thereof. The front face 40 has a horizontally extending aperture 42 located adjacent an upper end.

A wall 12 of the lower chamber 16 is attached directly to the front face 40 by any suitable means such as welding. The channel 36 extends upwardly substantially beyond the grill 14.

In use, a firelighting cake is placed on a grill in a covered kettle or other cooking vessel or barbeque apparatus. The cake is positioned in the required position where a fire is needed. The cake is lighted in known manner by use of a match or other form of lighter. The combustion chamber apparatus 10, is placed over the lighted cake such that the cake is located in the interior 18 of the chamber 16. Fuel beads or other solid fuels are placed around the combustion chamber apparatus 10. Heat and flames from the burning firelighter circulate through the slots 25 in the plate 24 and into the space 26. The heat and flames are then transmitted from the cake and through the apertures 20 in the grill 14 to the solid fuel. The chamber 16 and grill 14 provide a combustion space for the firelighter cake to burn freely without the fuel beads smothering the flames by depriving the fire lighter of an adequate combustion space.

The slots 25 in the plate 24 enable the firelighter flames to be distributed evenly throughout the upper space 26. It is suggested that the ignition rate of the firelighter is accelerated by enclosing it in the chamber 16. The flames from the firelighter are modified by passing through the slots 25 and are concentrated into the upper space 26 where it is in fluid contact with the fuel beads through the apertures 20 in the grill 14. This concentration of the firelighter flames low in the fuel pile promotes more rapid ignition of the solid fuel.

The shroud 30 may be used to contain fuel beads. Thus, the beads are maintained around the flames from the firelighter in proximity thereto which allows efficient solid fuel ignition. Similarly, a containment structure may be formed from the channel 36 and the wall of the cooking vessel by placing the open end of the channel 36 against the wall of a cooking vessel. The tapered sides 38 conform substantially to the internal profile of a cooking vessel; further, if necessary, two such channels can be placed on opposing sides of the vessel.

It has been found in practice that the time required for the satisfactory ignition of the solid fuel briquettes using the combustion chamber apparatus of the present invention is in the region of 20 to 25 minutes, compared with the more usual 45 minutes required for the conventional ignition process.

When the fuel beads are sufficiently ignited the shroud 30 and channel 36 may be removed by using a pair of tongs in the apertures 34,42. The loose fuel beads discharge through the open end of the shroud 30 or channel 36 and settle to form a cooking fire. They may be spread over the cooking area to provide an even cooking temperature across the cooking area or, they may be left concentrated in one position such that a temperature gradient is created across the cooking area to provide more control of the cooking process.

It is clear that the configuration of any outer containment structure may be varied without departing from the scope of the present invention. Thus, for example, the shroud 30 could be replaced by a square or rectangular shroud or the sides 38 of the channel 36 could be splayed outwardly with respect to the face 40.

It is also clear that the configuration of the grill 14 may be varied. Thus, for example, the upwardly converging walls could be replaced by a curved section. Modifications and variations such as would be apparent to a skilled addressee are deemed within the scope of the present invention.

I claim:

1. A combustion chamber apparatus comprising a hollow open ended chamber arranged to receive a fire lighting cake therein, an apertured grill attached to said chamber at edges thereof said grill arranged to extend substantially higher than said chamber, and apertured plate mounted on an upper surface of said chamber and extending over an open end thereof, said plate and said grill serving to define an upper space in fluid communication with the interior of said chamber, said combustion chamber apparatus further comprising means for maintaining combustible material adjacent the chamber said means comprising a hollow open ended container surrounding said chamber and attached thereto by means of plates extending from sides of said chamber to said container.

2. A combustion chamber apparatus according to claim 1, in which the grill is attached to opposing sides of the chamber at upper edges thereof.

3. A combustion chamber apparatus according to claim 1, in which the grill has 60% of the surface thereof being open.

4. A combustion chamber apparatus according to claim 1, in which the apertured plate has longitudinally extending slots therein.

5. A combustion chamber apparatus according to claim 4, in which a central slot is 2.8 to 3.2 mm in width and the distance between each slot is 20 mm.

6. A combustion chamber apparatus according to claim 12, wherein the container comprises a hollow open ended cylinder located around the apparatus and spaced apart therefrom and in which the cylinder has a pair of horizontally extending diametrically opposed apertures located adjacent an upper and thereof.

* * * * *